US009845233B1

(12) United States Patent
Stibinger

(10) Patent No.: US 9,845,233 B1
(45) Date of Patent: Dec. 19, 2017

(54) ADAPTIVE UNIVERSAL FUNNEL POURER

(71) Applicant: Gabor Alex Stibinger, Succasunna, NJ (US)

(72) Inventor: Gabor Alex Stibinger, Succasunna, NJ (US)

( * ) Notice: Subject to any disclaimer, the term of this patent is extended or adjusted under 35 U.S.C. 154(b) by 0 days.

(21) Appl. No.: 15/263,631

(22) Filed: Sep. 13, 2016

(51) Int. Cl.
*B65B 39/00* (2006.01)
*B67C 11/02* (2006.01)
*B65D 47/06* (2006.01)

(52) U.S. Cl.
CPC ..... *B67C 11/02* (2013.01); *B65D 47/06* (2013.01)

(58) Field of Classification Search
CPC ..... B67C 11/00; B67C 11/02
See application file for complete search history.

(56) References Cited

U.S. PATENT DOCUMENTS

| | | | | |
|---|---|---|---|---|
| 1,396,606 | A | 11/1921 | Vincent | |
| 3,211,195 | A | 10/1965 | Porter | |
| 5,472,025 | A | 12/1995 | Conrad | |
| 8,109,399 | B1 | 2/2012 | Sheffield | |
| 8,689,987 | B2 | 4/2014 | Lewis | |
| D738,169 | S | 9/2015 | Weisenbach | |
| 2009/0107582 | A1 | 4/2009 | Sayage | |
| 2011/0308667 | A1* | 12/2011 | Gallegos | B65B 39/00 141/340 |
| 2014/0137985 | A1* | 5/2014 | Zitkovic | B67C 11/02 141/331 |

* cited by examiner

*Primary Examiner* — Jason K Niesz
(74) *Attorney, Agent, or Firm* — Baldini Law, LLC; Jack B. Baldini, Esq.

(57) ABSTRACT

The present disclosure is directed to funnels, specifically, funnels made to supportably adapt to containers with varying neck opening dimensions and configurations. Disclosed herein is a funnel that can be used to both funnel substances into varying sized containers as well as used to neatly pour the substances within the container back out, wherein the particular dimensions and configurations of the neck opening of that container is unimportant.

6 Claims, 8 Drawing Sheets

ADAPTIVE UNIVERSAL FUNNEL POURER

FIELD OF THE INVENTION

The present disclosure is directed to funnels, specifically, funnels made to supportably adapt to containers with varying neck opening dimensions and configurations. Disclosed herein is a funnel that can be used to both funnel substances into varying sized containers as well as used to neatly pour the substances within the container back out, wherein the particular dimensions and configurations of the neck opening of that container is unimportant.

BACKGROUND

Funnels used to assist with filling substances into containers with small neck entrances are well known. In fact, funnels have been adapted for specialty use in many various environments, such as in kitchens, in automotive garages and in industry. The containers themselves into which substances are desired to be funneled are very different. Some have screw on openings that fit caps of certain sizes and configurations, such as varying size bottles. Some are smooth such as filler tubes in the automotive industry. The corresponding funnels made to adapt to different situations have been configured to mate to the various sizes and configurations of the filler necks of these containers. Other than a basic funnel, without any specific mating ability, but merely having a small stem opening that can fit into a small neck opening of a larger container without any stabilization feature, none of these funnels are a one size fits all. The basic one size fits all funnel that has no specific mating properties towards the filler necks of a container are highly unstable and must be independently secured (even hand held) so that it does not wobble around during filling and it cannot function as a pourer to neatly pour substances within the container back out.

Today, as a result of a recent explosion of water consumption driven by marketing convincing the public of the many benefits of bottled water and its purity and safety, it is commonplace for folks to buy, carry and use water bottles of all varying sizes and configurations. Some people like individual bottles. Some people like larger bottles because of the cost savings. Some people like 'wide-mouth' bottles because they are easier to drink from.

Another recent trend, again as the result of marketing, is the desire to add nutrients, flavorings and other ingredients into those water bottles. The varying bottle sizes and corresponding neck dimensions and configurations make certain funnels made to work in one situation unable to work in other situations.

Moreover, it is inconvenient to carry a multitude of tools simply to add these ingredients into a water bottle. It would be useful to have one small, simple, inexpensive, universally adaptable funnel that securably attaches to any size and configured water bottle for adding these ingredients. It would be even more useful if that same tool could also function to allow the water, with the ingredients added and blended, to be poured neatly back out of the bottle into individual drink containers or cups.

There have been many attempts to solve the universal funnel problem. For example, U.S. Pat. No. 3,211,195 titled FUNNEL IMPROVEMENT, discloses, "an improved funnel construction which is adaptable for rigid attachment to containers with various size filler openings." This disclosure requires annular ridges of various sizes and configurations such that the adaptive funnel essentially screws onto the container to be filled.

In another example, U.S. Pat. No. 1,396,606 titled FUNNEL, discloses, "a novel form of funnel mainly designed for filling radiators or automobiles and the like, the principal object of the invention being to provide a funnel whereby water can be poured into the radiator without spilling the same over the radiator and without wasting any through the overflow pipe of the radiator." This disclosure also shows a collar, detachable from the funnel allowing the funnel to rest supportably on the radiator opening no matter the size of the opening. However, this disclosure teaches that the funnel merely balances itself, not that it is securably stabilized.

In another example, U.S. Pat. No. 5,472,025 titled INVERSAL FUNNEL ADAPTOR, discloses, "an adapter for stabilizing a funnel in the opening of a container consists of a body of metal or plastic which contains a central bore internally threaded at each end for accepting the threaded stem of a funnel. The body is externally threaded on one end to engage internally threaded container openings and at the other end contains an internally threaded cavity to engage externally threaded container openings." This disclosure is not actually a funnel, but a funnel adapter and requires a specialized funnel with a threaded stem. Moreover, all adaptations of the adapter are screw on threads of varying size configurations.

In another example, U.S. Pat. No. D738,169 titled, FUNNEL, discloses an ornamental design of an ordinary funnel that has "stepped protrusions disposed on the external surface of the spout portion." Essentially, this disclosure teaches an ordinary funnel wherein the small circumference stem comprises sequentially larger stepped protrusions that allow the stem to be more secure within the filler opening of varying sized and configured container openings. However, this mating configuration does not result in a watertight or airtight seal; it is merely for adding stability to the funnel sitting in the opening.

In another example, U.S. Pat. No. 8,689,987 titled CONTAINER ADAPTER, discloses, "a container adapter for feeding human infants and animal infants is shown. The container adapter has an internal threaded portion that can comprise a set of thread segments sized and configured to match the external threads of a commercially available soda or bottled liquid container, and can have an external threaded portion sized to match the internal threads of a standard nipple ring for an infant feeding bottle. The container adapter includes a funnel that provides a user with assistance in inserting infant feeding ingredients into the liquid container by placing the container adapter on the liquid container to use the funnel of the container adapter to place infant feeding ingredients into the liquid container. The container adapter is then inverted and installed onto the liquid container. A nipple within a collar is attached to the container adapter thus converting the liquid container to an infant feeding bottle." This disclosure teaches utilizing varying sized threads, internally and externally disposed, to utilize a liquid bottle as a baby feeding bottle. In all configurations, it requires threading the device on existing screw threads of the liquid bottle.

In another example, U.S. Pat. No. 8,109,399 titled DRINK BOTTLE FUNNEL, discloses, a "a drink bottle funnel for attaching securely to a drink bottle to facilitate pouring flavoring into the drink bottle includes a main portion formed by a circumferential wall having a top opening and a bottom opening. A tubular connection portion extends from the main portion around the bottom opening.

An interior surface of the connection portion has interior surface threads. Thus, the connection portion is designed for threadably engaging the threaded neck of a drink bottle." This disclosure, like the last reference, teaches threading the device on existing screw threads of a water bottle. It has only one size. Its main advantage is that it can screw onto the water bottle right side up so that it can be used as a funnel and then also inverted so that it can be stored on the water bottle when not in use. It has outer threads as well to accept a cap to close the configured bottle. It is not adjustable and fits only with a properly sized and configured water bottle.

Finally, in another example, U.S Patent Application, Publication No. US 2009/0107582 titled DETACHABLE FUNNEL FOR WATER BOTTLES, discloses, "a detachable funnel apparatus for use with a container has an open wide end, an open narrow end, and sidewalls connecting the open wide end to the open narrow end whereby materials poured into the open end pass through the sidewalls and out the open narrow end when the detachable funnel apparatus is coupled to the container. The funnel is configured to removably affix to the container when stored by a coupling mechanism on the inside of the funnel such as a ring snap to create a snap connection between the funnel and a neck ring on the container or threads to connect to the threads on the container normally used by the cap of the container." This disclosure, similarly to the last reference, teaches a funnel that threadably secures to a water bottle and also inverts for storage purposes. This disclosure also teaches a snap connection, but only in the inverted storage configuration, requiring the threaded connection to maintain a watertight seal for filling, or, if in an unthreaded configuration, acting as a normally non-watertight funnel merely resting in the opening of the bottle to be filled.

None of the foregoing references, alone or in combination, teach the salient and proprietary features of the present disclosure. While there are many funnels that adapt to various sized container openings, they all address or require a threaded connection believing this necessary for both a stable, secure connection and a watertight connection. There are other adapters for funnels, but they require specially threaded funnels. And, where pouring is a desired functionality, only specifically watertight threaded connections that require specificity in dimensions and configuration have worked. There remains a need for a simple, universal funnel, that requires no threaded connection, that nevertheless when attached is secure for hands free operation, and is watertight such that not only will no spillage occur during filling, when in place, the funnel is secure and watertight enough that it can act as a pour spout, as well.

The present disclosure teaches several embodiments of a funnel that can adapt to various sized container openings and configurations, without any screw on threading (indeed, there are no threaded screw ridges taught in this disclosure), such that the funnel simply fits into place, is secure enough for hands free filling, is also secure enough that it will remain in place for pouring and act as a pour spout, and detaches as simply as it fit into place. This disclosure teaches a funnel that has the foregoing properties whether fitting a small individual water bottle or a large mouth bottle or larger gallon jugs and the like.

SUMMARY

The present disclosure teaches embodiments of a funnel that modify an ordinary funnel configuration, utilize the existing properties of certain silicone and rubberized materials, such that the stem is sized and configured to snugly fit into certain of the smaller mouth water bottles with a slight taper to the stem. In one embodiment, there is also a ring collar, slightly larger than the stem fitted partially up the frustoconical portion of the funnel mid-section that has resilient tabs that can expand slightly to grip the outer edges of larger mouthed containers securing the resilient silicone or rubberized material against the mouth. In another embodiment, a handle portion at the top of the funnel is added to aid in funnel manipulation and storage. In yet another embodiment, the rim of the upper large open end of the frustoconical portion of the funnel is beveled to aid in pouring.

The present disclosure teaches embodiments of constructing a funnel that include using certain materials such as semi-soft rubber, silicone or other elastomer with properties of rigidity and malleability to construct the funnel. When these types of materials are used, the inherent properties of the material when resting against the plastic or glass of typical water, soda or other drink containers, forms a watertight seal with very little downward pressure. Silicone elastomers are well known for their properties including heat stable, sterilizable, hydrophobic, high dielectric strength, durable, pigmentability and can be food grade compliant.

In one embodiment, the foregoing funnel is formed with a frustoconical upper portion joined with a slightly tapered stem at its smaller bottom section with the taper going slightly smaller as it descends downward. The upper portion of the stem has as large an outer surface diameter as the inner surface diameter of the smallest drink container that would be desired to be filled with the funnel. In this manner, the stem will insert into the mouth of such a drink container and simply get stuck as the tapered stem inserts downward, yet will disengage fairly easily with some upwards pull. The material of the funnel will prevent it from simply slipping out.

In one embodiment, the foregoing funnel can be used with larger opening drink containers where the stem is too small to get stuck where the added ring collar containing resilient tabs is so positioned such that when the stem is inserted into the mouth of the drink container and the frustoconical portion of the upper portion of the funnel meets the mouth opening, the resilient tabs can open slightly and grab onto whatever mechanism is present at the mouth opening of the drink container, typically threads for its screw on cap, and spring back holding the mouth opening of the drink container firmly against the frustoconical portion of the upper funnel that meets at that juncture. Again, because of the inherent properties of the silicone or rubber or other suitable material, a tight seal is formed.

In one embodiment, the upper rim large opening of the frustoconical upper portion of the funnel is fabricated with a beveled edge such that while the funnel is in place in any of the foregoing configurations, the seal will prevent liquid from leaking and the funnel is now capable of acting as a pourer.

In one embodiment, the funnel is also fabricated with a handle portion at the upper large opening of the frustoconical upper portion of the funnel, making it easy to handle, remove, store and use.

The present disclosure teaches a funnel comprising:

- a frustoconical top portion having a wide mouthed top opening tapering down to a concentrically smaller bottom opening, the whole of which has an inner surface and an outer surface;
- a stem bottom portion with a top opening and a bottom opening the whole of which has an inner surface and an outer surface wherein the top outer surface of the stem is the same size and connected to the bottom outer surface of the frustoconical top portion and further that the bottom opening of the stem outer surface is just slightly smaller in circumference and tapering from the top portion outer surface of the stem;

a ring collar positioned on the lower outer surface of the frustoconical top portion comprising a ring extending vertically downward from said outer surface of the frustoconical top portion further comprising at least one resilient tab positioned on the bottom portion of the ring collar.

In one embodiment, the foregoing funnel is made from a material such as silicone, vulcanized semi-soft rubber, or other suitable material that has inherent water-sealing properties and is soft and resilient enough to allow the stem to form a seal with the inside mouth of drink containers and yet stable enough that the funnel can work hands-free.

In one embodiment, the foregoing funnel may be constructed of any suitable material wherein there exists at least at the areas of the outer surfaces that will come into contact with drink containers, there exists a suitable water-sealing material.

In one embodiment, the inner surfaces are all joined smoothly and evenly so as to allow full flow in either direction.

In one embodiment, the thickness of the funnel from the outer surfaces to the inner surfaces is just thick enough to allow the funnel to remain semi-pliable and yet rigid enough to be stable for hands-free operation.

DETAILED DESCRIPTION

Figure 1:
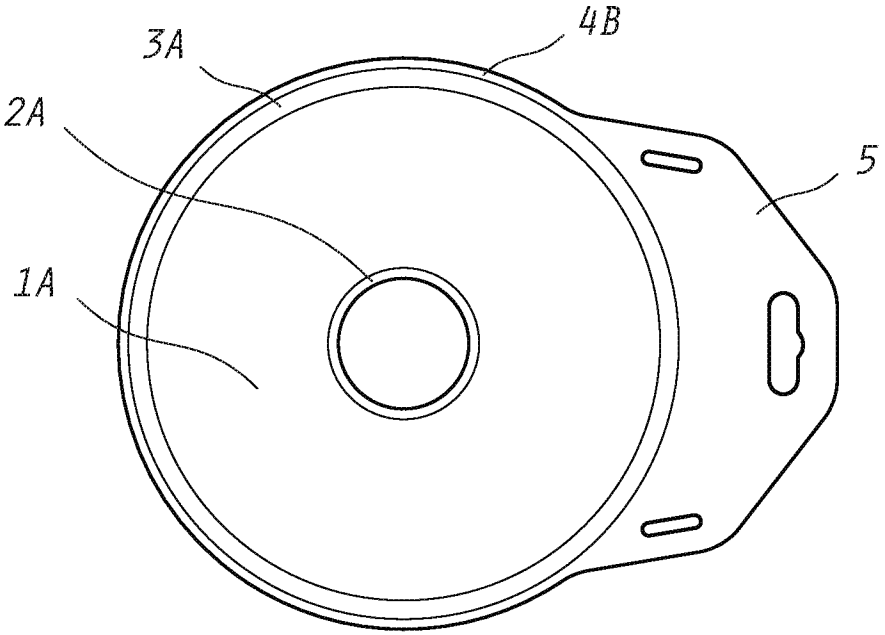
FIG. 1 depicts a top view of one embodiment of the funnel of the present disclosure peering into the top from above showing the inside surface of the upper frustoconical portion (1A), the inside surface of the upper frustoconical portion where it joins with the upper portion of the bottom stem (2A), the upper large opening of the frustoconical upper portion showing the components of the beveled edge (3A) and (4A), and a configuration of a handle attached to the upper frustoconical top (5).
Figure 2:
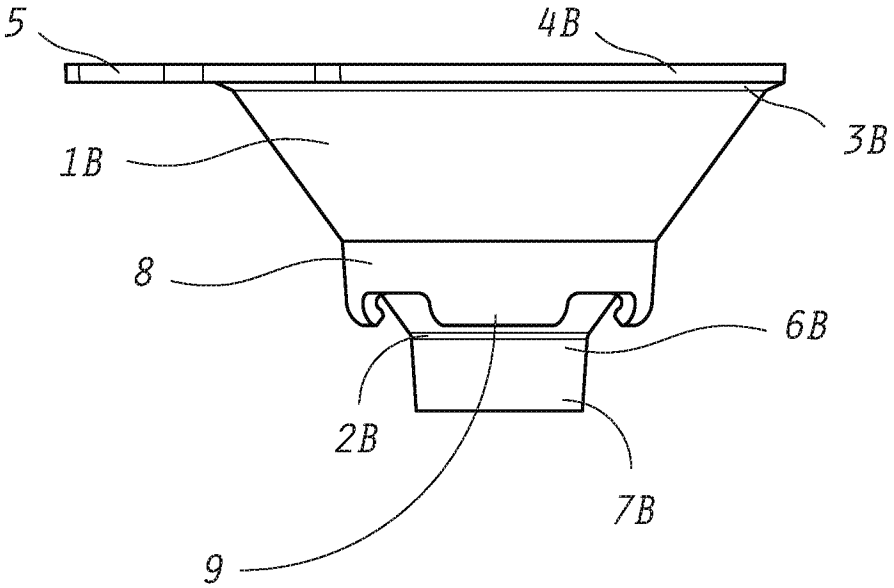
FIG. 2 depicts a side view of one embodiment of the funnel of the present disclosure looking at the outer surface areas showing the outer surface of the upper frustoconical portion (1B), the side of the top of the frustoconical portion showing the outer surfaces of the beveled edge (3B) and (4B) and handle (5), the outer surface of the lower portion of the frustoconical top where it meets the outer surface of the top of the lower stem portion (2B), the top of the lower stem portion (6B) and lower area of the lower stem portion (7B) showing a slight taper, and the ring collar (8) and resilient tabs (9).
Figure 3:
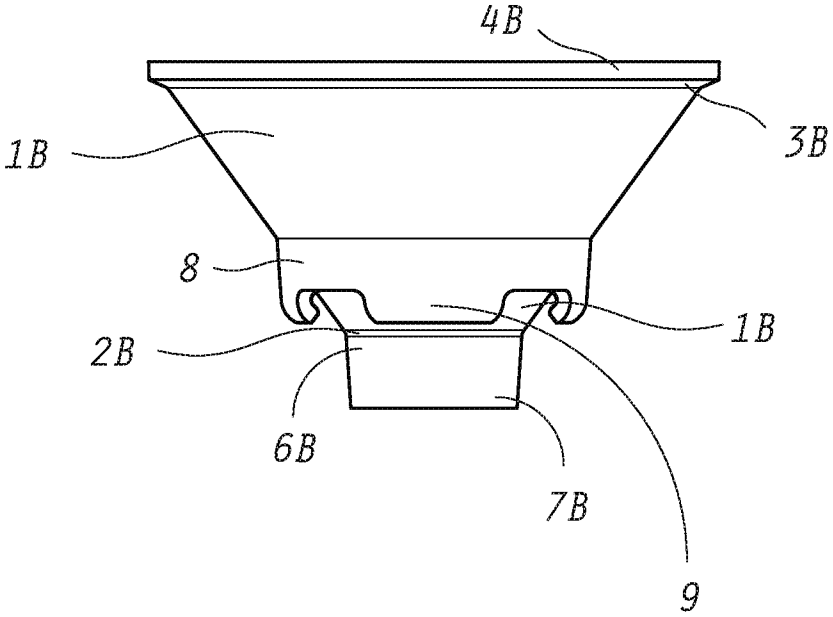
FIG. 3 depicts a side view of one embodiment of the funnel of the present disclosure looking at the outer surface areas showing the outer surface of the upper frustoconical portion (1B), the side of the top of the frustoconical portion showing the outer surfaces of the beveled edge (3B) and (4B), the outer surface of the lower portion of the frustoconical top where it meets the outer surface of the top of the lower stem portion (2B), the top of the lower stem portion (6B) and lower area of the lower stem portion (7B) showing a slight taper, and the ring collar (8) and resilient tabs (9).
Figure 4:
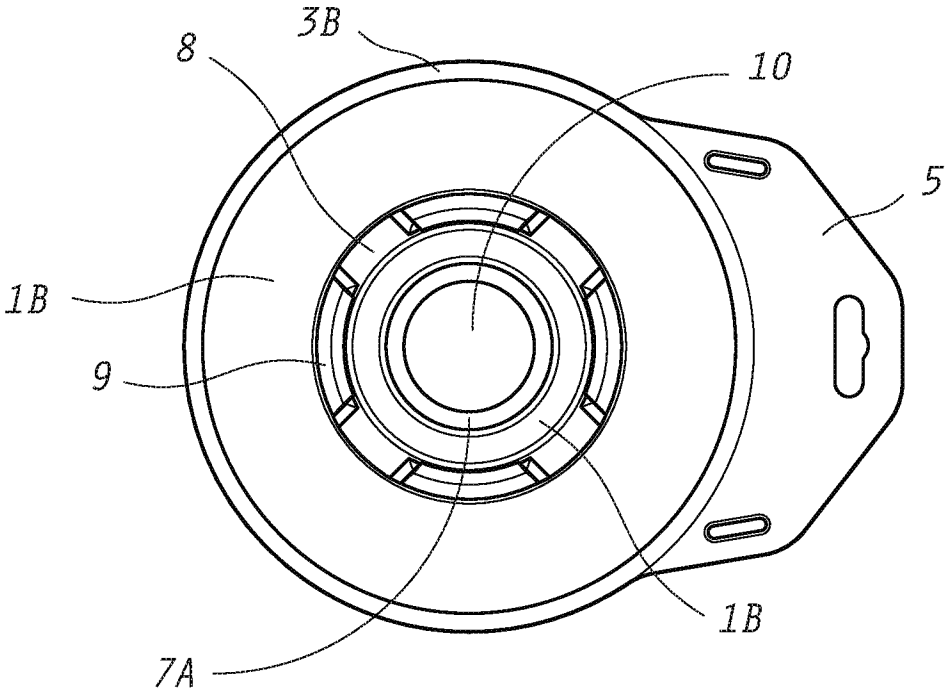
FIG. 4 depicts a bottom view of one embodiment of the funnel of the present disclosure peering up from the bottom showing the funnel hole through which materials pass through (10), the outside surface of the upper frustoconical portion (1B), the underside of the upper ring beveled edge (3B), the underside of the handle (5), the ring collar (8) and resilient tabs (9), and the inside surface of the lower stem portion (7A).
Figure 5:
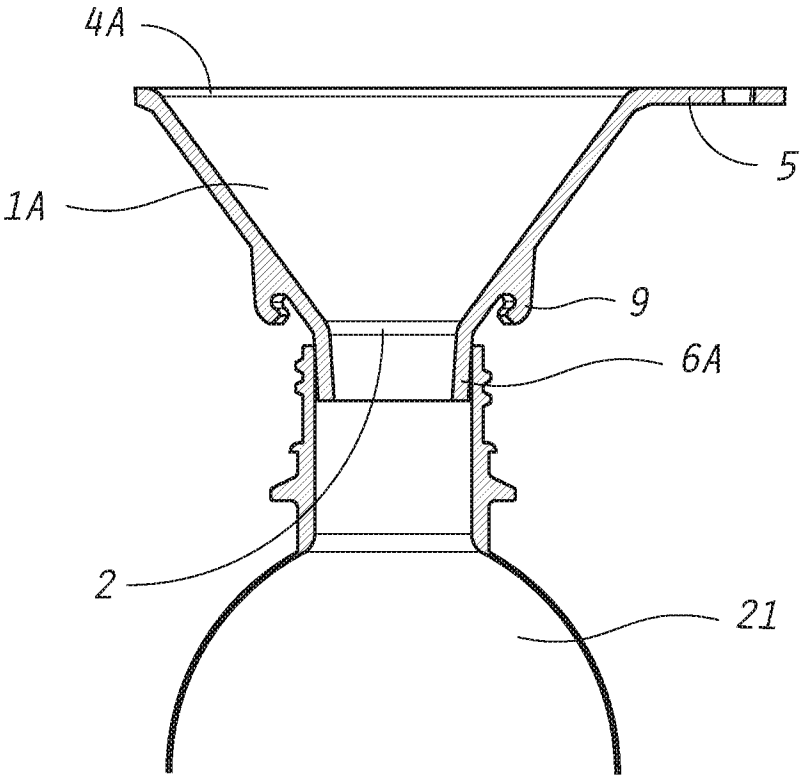
FIG. 5 depicts a cutaway view of one embodiment of the funnel of the present disclosure showing the outside surface of the top of the lower stem portion (6A) contacting the inside surface area of the neck opening of a small drink bottle (21) wherein the tabs (9) stay above the mouth opening. The outer surface area of the frustoconical top portion of the funnel (1A), beveled edge (4A), handle (5) and area where the lower part of the upper frustoconical portion joins with the upper area of the slightly tapered bottom stem portion (2) are also shown.
Figure 6:
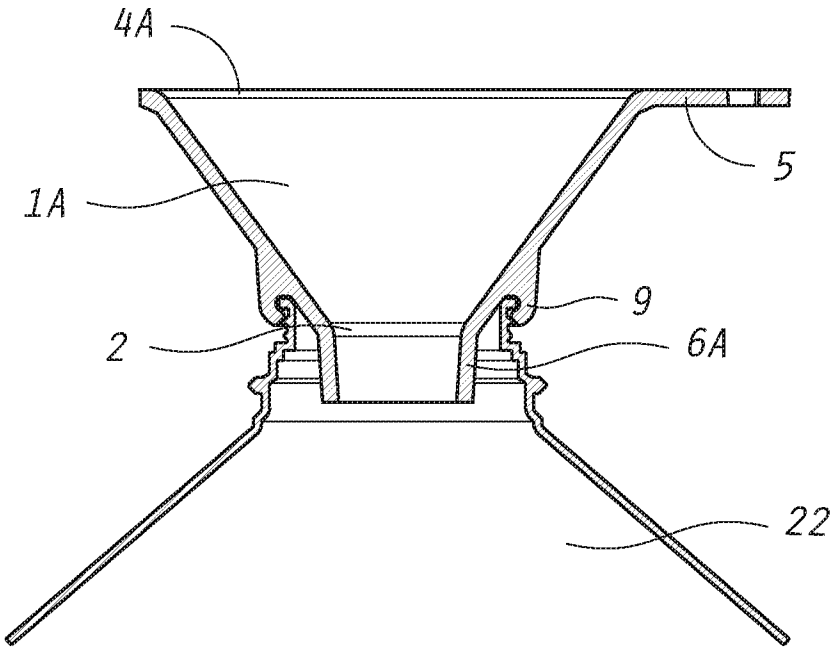
FIG. 6 depicts a cutaway view of one embodiment of the funnel of the present disclosure showing the outside surface of the top of the lower stem portion (6A) not contacting the inside surface area of the neck opening of a large mouth drink bottle (22) wherein the tabs (9) contact the upper portion of the mouth opening and secure the outside surface area of the frustoconical top portion of the funnel (1A) against the mouth opening. The beveled edge (4A), handle (5) and area where the lower part of the upper frustoconical portion joins with the upper area of the slightly tapered bottom stem portion (2) are also shown.
Figure 7:
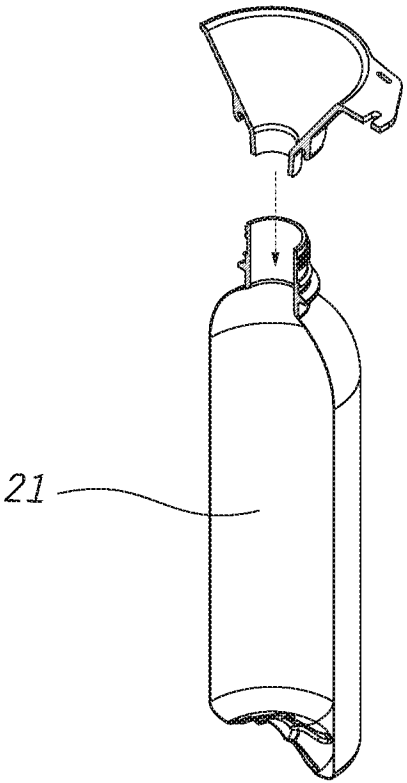
FIG. 7 depicts a cutaway view of generally the downward insertion of one embodiment of the funnel of the present disclosure fitting into the small mouth opening of a small drink bottle (21).
Figure 8:
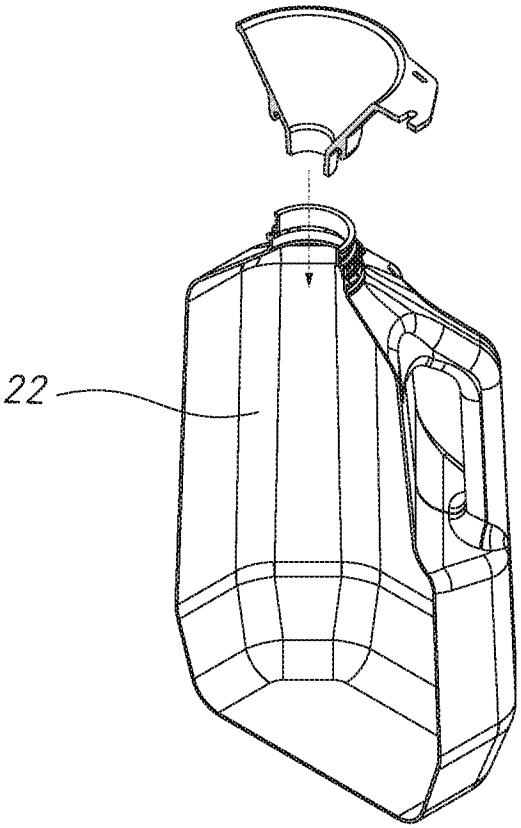
FIG. 8 depicts a cutaway view of generally the downward insertion of one embodiment of the funnel of the present disclosure fitting into the large mouth opening of a large drink bottle (22).

For clarity of disclosure, and not by way of limitation, the detailed description of the invention is divided into the following subsections that describe or illustrate certain features, embodiments or applications of the present invention.

Definitions

"frustoconical top portion" as used herein means the top portion of a funnel from the wide top opening to the point where it meets and joins with the stem bottom portion.

"stem bottom portion" as used herein means the bottom stem portion of a funnel from its tip at the bottom that inserts into the opening of a container to be filled up to the point where it meets and joins with the frustoconical top portion.

"ring collar" as used herein means a specialized attachment means for attaching resilient tabs to the outer surface of the frustoconical top portion.

"resilient tabs" as used herein means semi-flexible tabs attachable to the frustoconical top portion of the funnel used to secure the funnel to containers wherein the mouth opening of the container is larger than any portion of the outer surface diameter of the stem bottom portion.

The System and Method of the Present Invention

An ordinary funnel has a frustoconical top portion and an stem bottom portion and can be made from almost any material. However, one of the untold truths of the mechanical arts is that such funnels need to be stabilized to be used safely and neatly. Typically, this requires an extra hand.

The present disclosure teaches embodiments of a funnel that securably attaches to the container that is to be filled.

Embodiments herein disclose that the funnel may have a bottom stem portion that securely and snugly fits into the mouth of a properly sized container such that simple insertion and friction keep the funnel inserted, secure and watertight.

In an alternative embodiment, where the container opening is larger than the largest outer circumference of the bottom stem portion of the funnel, the funnel also contains a ring collar with resilient tabs that catch the outer rim of the container and grip it snugly to secure a portion of the outer surface of the bottom of the frustoconical top portion of the funnel to keep it inserted, secure and watertight.

In one embodiment, the funnel also contains a handle to aid in funnel manipulation and storage.

Herein is taught the utilization of materials with inherent properties of resiliency and stability and friction that allow the funnel to be snug without having to overtight, to be watertight without having to be forcibly clamped in place, only gripped by resilient tabs or merely snugly inserted. Such materials include silicone and semi-rigid vulcanized rubber.

EXAMPLES

The present invention is further illustrated, but not limited by, the following examples.

In a preferred embodiment, the outer diameter of the top opening of the top of the frustoconical top portion is 2¾ inches. In the same preferred embodiment, the bottom outside diameter of the bottom of the stem bottom portion has a diameter of approximately 11/16 of an inch or just less than ¾ of an inch. In the same preferred embodiment, the top of the stem bottom portion has a diameter of 13/16 of an inch or just over ¾ of an inch. In the same preferred embodiment, the outside diameter of the ring collar is approximately 1⅞ of an inch and has four evenly spaced resilient tabs. In the same preferred embodiment, the ring collar has a height of approximately ¼ of an inch and the resilient tabs have a height of approximately ⅛ of an inch. In the same preferred embodiment, the funnel has a thickness of approximately 3/32 of an inch and is made of silicone.

In a preferred embodiment, the handle has a hole punched into it so that the funnel may hang.

In a preferred embodiment, the funnel is formed by forcing liquefied silicone into a mold, cooling it and removing it so that it is all one piece construction.

Publications cited throughout this document are hereby incorporated by reference in their entirety. Although the various aspects of the invention have been illustrated above by reference to examples and preferred embodiments, it will be appreciated that the scope of the invention is defined not by the foregoing description but by the following claims properly construed under principles of patent law.

Each and every feature described herein, and each and every combination of two or more of such features, is included within the scope of the present invention provided that the features included in such a combination are not mutually exclusive.

What is claimed is:

1. A funnel comprising:

a frustoconical top portion having a wide mouthed top opening tapering down to a concentrically smaller bottom opening, the whole of which has an inner surface and an outer surface;

a stem bottom portion with a top opening and a bottom opening the whole of which has an inner surface and an outer surface wherein the top outer surface of the stem is the same size and connected to the bottom outer surface of the frustoconical top portion and further that the bottom opening of the stem outer surface is smaller in circumference and tapering from the top portion outer surface of the stem;

a ring collar positioned on the lower outer surface of the frustoconical top portion comprising a ring extending vertically downward from said outer surface of the frustoconical top portion further comprising at least one resilient tab positioned on the bottom portion of the ring collar.

2. The funnel of claim 1 wherein there are four resilient tabs.

3. The funnel of claim 1 further comprising a handle.

4. The funnel of claim 3 wherein the handle comprises at least one hole.

5. The funnel of claim 1 wherein such funnel is made from a solid one-piece construction.

6. The funnel of claim 1 wherein such funnel is made from silicone.

* * * * *